US006575125B1

(12) United States Patent
Ryan et al.

(10) Patent No.: US 6,575,125 B1
(45) Date of Patent: Jun. 10, 2003

(54) DUAL TORQUE BARREL TYPE ENGINE

(76) Inventors: Lawrence J. Ryan, 134 Kingswood Dr., Red Wing, MN (US) 55066; Richard N. Stuart, P.O. Box 280, Holder, FL (US) 34445

( * ) Notice: Subject to any disclaimer, the term of this patent is extended or adjusted under 35 U.S.C. 154(b) by 0 days.

(21) Appl. No.: 09/702,532

(22) Filed: Oct. 31, 2000

(51) Int. Cl.[7] ..... F02B 75/18
(52) U.S. Cl. ..... 123/56.1; 123/56.2
(58) Field of Search ..... 123/56.2, 56.1

(56) References Cited

U.S. PATENT DOCUMENTS

| | | | | |
|---|---|---|---|---|
| 2,243,817 | A | 5/1941 | Herrmann | 123/58.1 |
| 2,983,264 | A | 5/1961 | Herrmann | 123/58.1 |
| 4,432,310 | A | 2/1984 | Waller | 123/58.1 |
| 4,571,946 | A | 2/1986 | Demopoulos | 60/618 |
| 5,016,580 | A | 5/1991 | Gassman | 123/58.1 |
| 5,749,337 | A | 5/1998 | Palatov | 123/56.2 |
| 5,799,629 | A | 9/1998 | Lowi, Jr. | 123/56.8 |

FOREIGN PATENT DOCUMENTS

| | | | | |
|---|---|---|---|---|
| DE | 3408447 | * | 9/1985 | 123/56.2 |
| FR | 861625 | | 2/1941 | |
| FR | 1547410 | | 11/1968 | |
| GB | 390263 | | 4/1933 | |
| WO | WO 98/41734 | | 9/1998 | |

* cited by examiner

*Primary Examiner*—Noah P. Kamen
(74) *Attorney, Agent, or Firm*—Nawrocki, Rooney & Silvertson, P.A.

(57) ABSTRACT

The present invention is a barrel-type internal combustion engine. The engine is generally comprised of a plurality of cylinders arranged in in-line pairs, each in-line pair having a double headed piston therein. The cylinders are arranged surrounding a central shaft that has a cam thereon. The cam has two opposing sinusoidal surfaces extending outward and around the shaft for positioning the pistons in the cylinders and transferring the combustion energy to the output shaft. The cam has a plurality of alternating and equidistantly spaced rises and reverse rises forming each of the sinusoidal surfaces. The engine is constructed and arranged to align each rise and reverse rise with a cylinder such that the engine can produce a power stroke substantially simultaneously in each cylinder aligned with a rise and reverse rise.

11 Claims, 10 Drawing Sheets

DUAL TORQUE BARREL TYPE ENGINE

BACKGROUND OF THE INVENTION

The present invention is generally related to the field of internal combustion engines. In particular, the present invention relates to a barrel-type internal combustion engine capable of providing a power stroke from multiple cylinders simultaneously.

Engines come in many varieties and styles. For example, there are diesel, internal combustion, and external combustion engines, and within the internal combustion variety of engine there are several distinct types such as: V-type, In line-type, barrel-type internal combustion engines, and the like. Additionally, within the class of barrel-type engines are styles such as two stroke and four stroke engines.

Traditionally, all of these engine classes were only capable of providing a power stroke from one cylinder at a time. The general principle behind using engines to do work is to use the power stroke of the engine to turn a drive shaft which can be attached to any moving part intended to be moved by the engine. For example, the drive shaft can be attached to an axle and thereby turn wheels, can be attached to a propeller to turn the propeller, or can be used for any other suitable industrial or commercial use. The engine provides a torque force on the drive shaft that forces the shaft into motion. There are, however, several problems with this method of providing power from an engine.

The most significant problem is that the single firing provided by the explosion of combustible material during a power stroke causes vibrations within the engine and depending upon the attachment of the engine to a fixed device, the vibrations caused by the engine can cause the attachment of the engine to become loosened. Vibrational forces are amplified by the structural configuration of most engines resulting in the uneven balance of the engine. Further, vibrational forces have a tendency to reduce the longevity of the engine by vibrating the parts of the engine repeatedly and may provide a source of irritation to passengers of vehicles propelled by these engines.

Recently, barrel-type engines have been developed that can reduce the amount of vibrational forces act upon the engine. Generally, barrel-type engines have a set of cylinders on one end and a set of cylinders on the other end of the engine. The two sets of cylinders are arranged in-line with a piston that has a double head reciprocates within the in-line cylinders. The cylinders are arranged circularly around and parallel to the drive shaft. This arrangement provides a compact configuration and nearly perfect balance, resulting in reduced vibration.

The barrel-type engines fire a single cylinder on one end of the engine and during the duration of the power stroke a single cylinder from the other end is fired which reduces the vibration caused by the engine. However, the current configuration of these devices limits the amount of power and torque the engine is able to generate and does not completely balance the firing of the engine to further reduce the production of vibration from the engine.

The present invention addresses these needs, as well as other problems associated with existing barrel-type internal combustion engines.

SUMMARY OF THE INVENTION

The present invention is a barrel-type internal combustion engine. The engine is generally comprised of a plurality of cylinders arranged in in-line pairs, each in-line pair having a double headed piston therein. The cylinders are arranged surrounding a central shaft that has a cam thereon. The cam has two opposing sinusoidal surfaces extending outward and around the shaft for positioning the pistons in the cylinders and transferring the combustion energy to the output shaft. The cam has a plurality of alternating and equidistantly spaced rises and reverse rises forming each of the sinusoidal surfaces. The engine is constructed and arranged to align each rise and reverse rise with a cylinder such that the engine can produce a power stroke substantially simultaneously in each cylinder aligned with a rise and reverse rise.

The present device is designed to provide power strokes to multiple cylinders on each end of the engine that are arranged such that they are spaced equidistantly from each other around the drive shaft, thereby providing a balanced force around the shaft on each end of the engine, and have the sets of strokes of the two ends spatially offset from each other to provide lateral balance to the stroke forces.

One embodiment of the present invention is configured to provide two power strokes at one end of the engine that are in cylinders 180 degrees from each other and two strokes in cylinders 180 degrees from each other at the other end and wherein the two sets of strokes are offset by 90 degrees to each other. The configuration of the cylinders and the shape of the sinusoidal surfaces of the cam allows the four power strokes to take place substantially simultaneously on each power stroke of the engine.

One arrangement of the cylinders provides eight common cylinder chambers with double headed pistons defining eight cylinders on each end of the engine. A two-cycle engine with this arrangement allows the engine to provide thirty two power strokes per revolution of the drive shaft.

Another embodiment is configured to provide three power strokes at one end of the engine that are in cylinders 120 degrees from each other and three power strokes in cylinders 120 degrees from each other with an offset of 60 degrees between the sets of power stroke cylinders on the two ends. The configuration of the cylinders and the shape of the sinusoidal surfaces of the cam allows the six power strokes to take place substantially simultaneously on each power stroke of the engine. One arrangement of the cylinders of this configuration provides twelve common cylinder chambers with double headed pistons defining twelve cylinders on each end of the engine. A two-cycle engine with this arrangement allows the engine to provide seventy two power strokes per revolution of the drive shaft.

The formula that allows this system to provide power strokes to these multiple cylinders on every output shaft rotation provided that for each sinusoidal surface, the surface must have N rises ($N_r$) that are spaced at $360/N_r$ degrees from each other and N number of reverse rises($N_{rr}$) spaced at $360/N_{rr}$ degrees from each other and positioned at an offset of $360/(N_r+N_r)$ degrees from one end of the engine to the other end. Furthermore, the amount of cylinders and their positioning must be equal to any number divisible by $N_r+N_{rr}$.

The aforementioned benefits and other benefits including specific features of the invention will become clear from the following description by reference to the accompanying drawings.

DETAILED DESCRIPTION OF THE INVENTION

Figure 1:
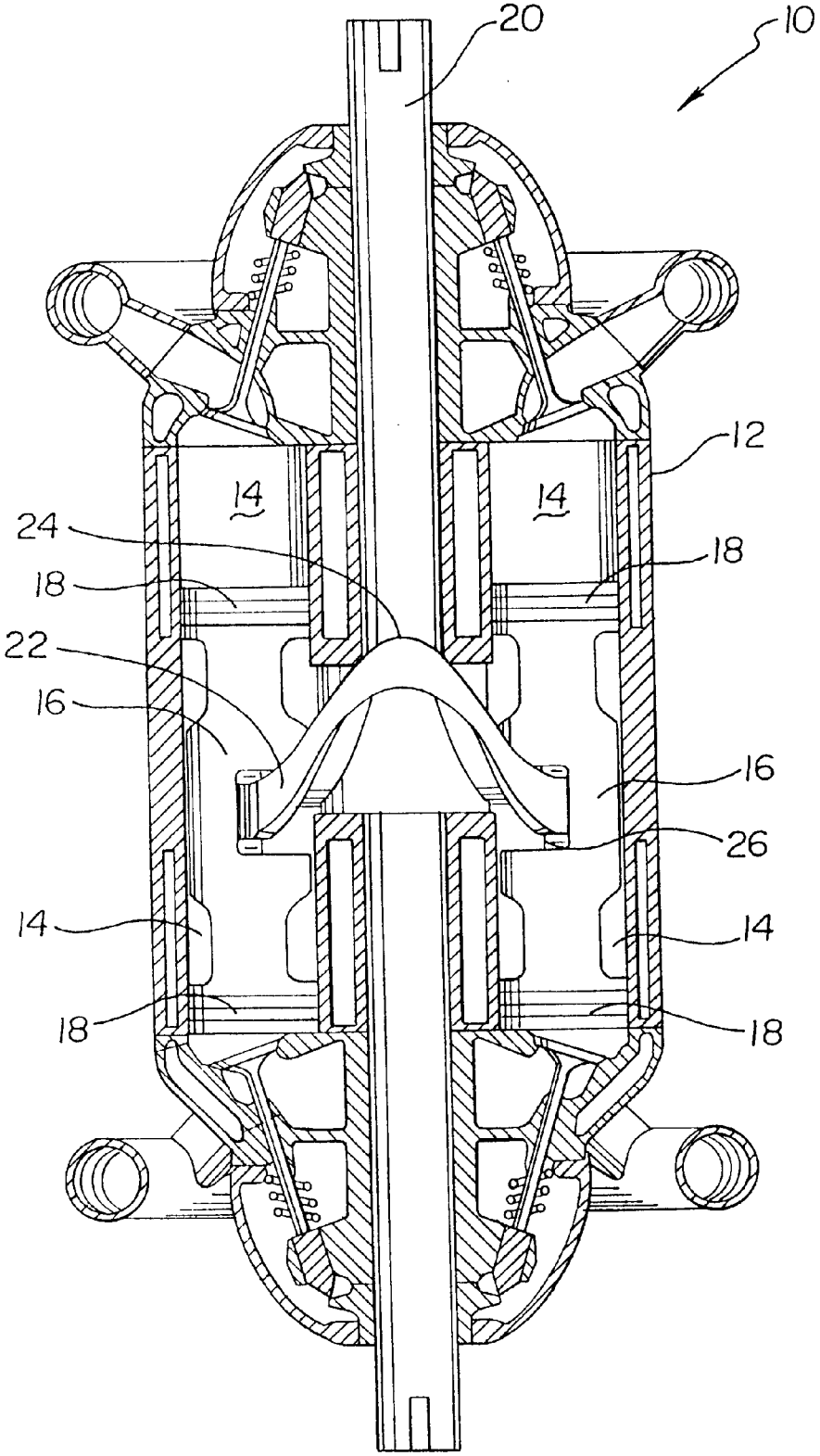
FIG. 1 is a cut away view of the interior of one configuration of a barrel-type device that could be utilized by the present invention.

Referring now to the drawings wherein like reference numerals denote like elements throughout the several views, FIG. 1 illustrates a typical barrel-type engine design. The design shown may be utilized with the proper amount of cylinders and number of rises and reverse rises on the sinusoidal surface of the cam as provided by the formula for achieving the optimal arrangement allowing for multiple power strokes on both ends of the engine and the arrangement of the strokes to provide proper balance to the engine.

In the embodiment shown in FIG. 1 the barrel-type engine generally comprises a housing 12 having a plurality of cylinders 14 defined therein. The cylinders 14 are aligned in an in-line manner wherein the cylinders are positioned facing each other. Each set of in-line cylinders has an elongate piston 16 with a piston head 18 on each end for compressing material within the cylinder 14 in order to accomplish the combustion process. The cylinders 14 are aligned in parallel with a center drive shaft 20 extending through the center of the housing 12. The drive shaft 20 has a cam 22 located within the housing 12 for moving the pistons 16 and for transferring force from the pistons 16 to the drive shaft 20. The cam 22, as shown, has two opposing sinusoidal surfaces each surface having two rises 24 and two reverse rises 26 thereon for providing a proper guide means to control the position of the pistons 16.

Figure 2B:
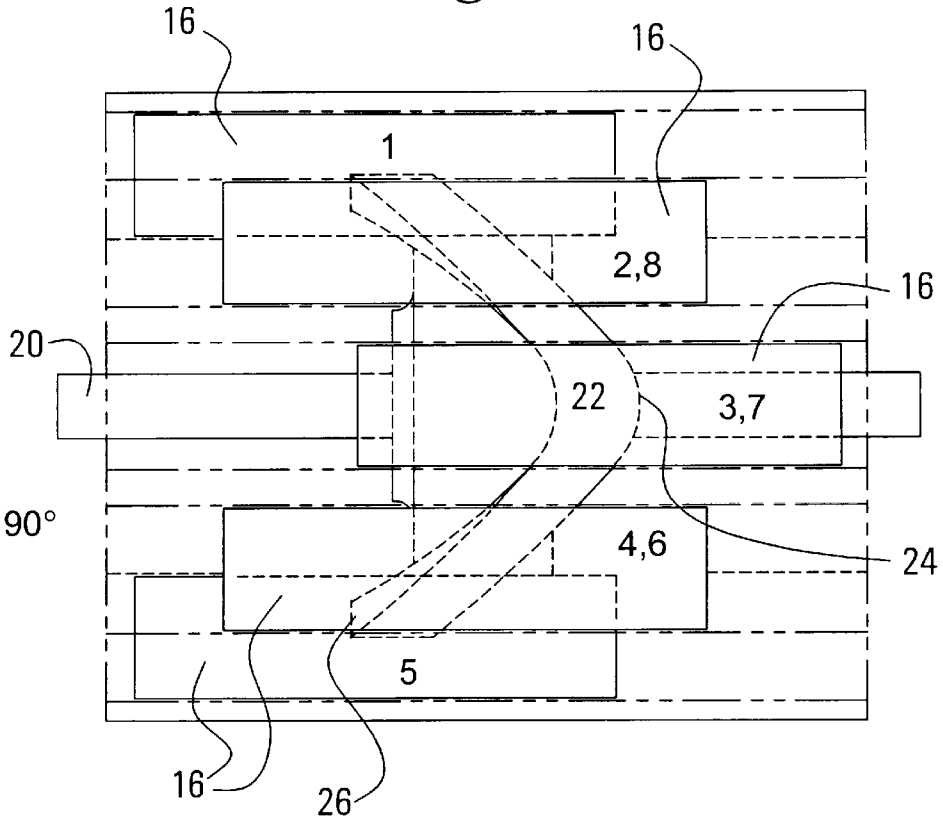
FIG. 2*b* is a schematic view of the embodiment of FIG. 2*a* showing the positions of the pistons with respect to the sinusoidal surfaces of the cam.
Figure 2A:
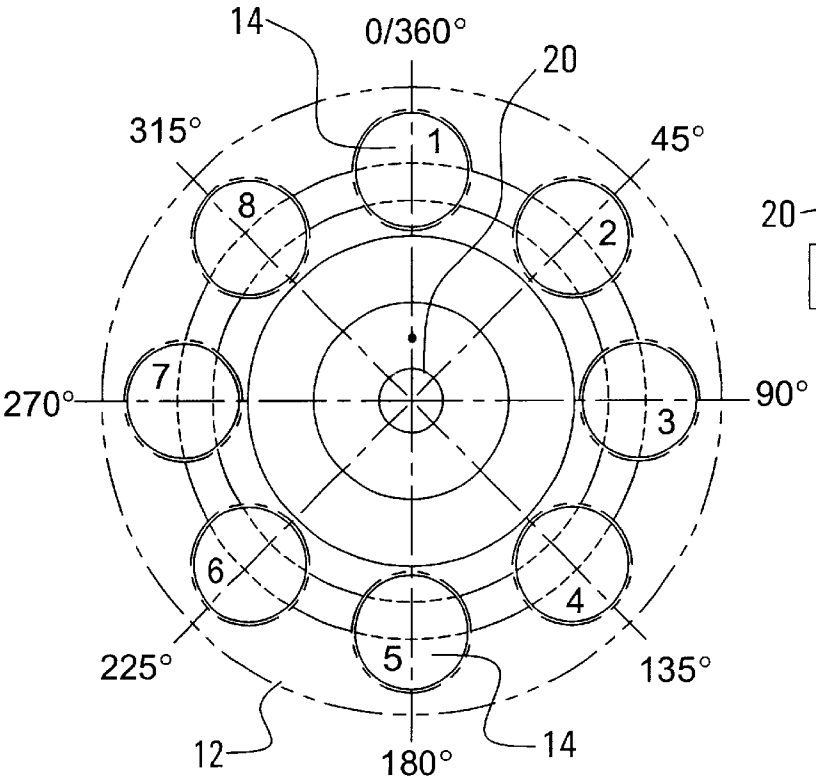
FIG. 2*a* is a schematic view of one end of the engine of an embodiment having eight cylinders on each end.

An embodiment of the present invention having eight cylinders in an end of the engine is shown in FIGS. 2*a* and 2*b*. In this embodiment, each end of the engine has eight cylinders, numbered 1–8 that are arranged equidistantly from each other and are annularly arranged around the center of the engine which comprises the drive shaft 20 of the engine.

The present device is designed to utilize power strokes from multiple cylinders on each end of the engine that are arranged such that they are generally spaced equidistantly from each other around the drive shaft, thereby providing a balanced force around the shaft on each end of the engine, and have the sets of strokes provided by the cylinders of the two ends spatially offset from each other to provide lateral balance to the stroke forces.

The formula that allows this system to provide power strokes to these multiple cylinders on every alignment of the rises and reverse rises with a set of cylinders provides that for each sinusoidal surface, the surface must have N rises ($N_r$) that are spaced at $360/N_r$ degrees from each other and N number of reverse rises ($N_{rr}$) spaced at $360/N_{rr}$ degrees from each other and positioned at $360/(N_r+N_{rr})$ degrees from the rises. Furthermore, the amount of cylinders and their positioning must be equal to any number divisible by $N_r+N_{rr}$.

The embodiment of the present invention shown in FIGS. 2*a*–13, is configured to provide two power strokes at one end of the engine that are in cylinders 180 degrees from each other (N=2, so according to the formula 360/2=180) and two power strokes in cylinders 180 degrees from each other (360/2) on the other end of the engine and wherein the two sets of power strokes are offset by 90 degrees from each other (360/4). The configuration of the cylinders and the shape of the sinusoidal surfaces of the cam allows the four power strokes to take place substantially simultaneously on each power stroke of the engine.

One arrangement of the cylinders provides eight common cylinder chambers with double headed pistons defining eight cylinders. The number of cylinders is divisible by $N_r+N_{rr}$ which is 4. As shown in FIGS. 2*a* and *b,* pistons 1 and 5 are in the Top Dead Center (TDC) position with respect to the left side of the engine as it is shown. This position is commonly referred to as describing the position in which the cylinder is at the beginning of the power stroke, it is also the end of the compression stroke. Pistons 2 and 6 are in the middle of their power stroke (MSP) as they are traveling from TDC toward the end of the stroke, or bottom dead center. Pistons 3 and 7 are in the Bottom Dead Center (BDC) position with respect to the left side of the engine which means that they have reached the-end of the power stroke and are going to begin the compression stroke, however since there are is a set of cylinders on the right side of the engine, the piston is in the Top Dead Center position with respect to the cylinders on the right hand side of the engine, therefore pistons 3 and 7 are in the power stroke with respect to the cylinders on the right hand side of the engine. Pistons 4 and 8 are in the middle of the compression stroke (MSC) as they travel from BDC to TDC.

Figure 3:
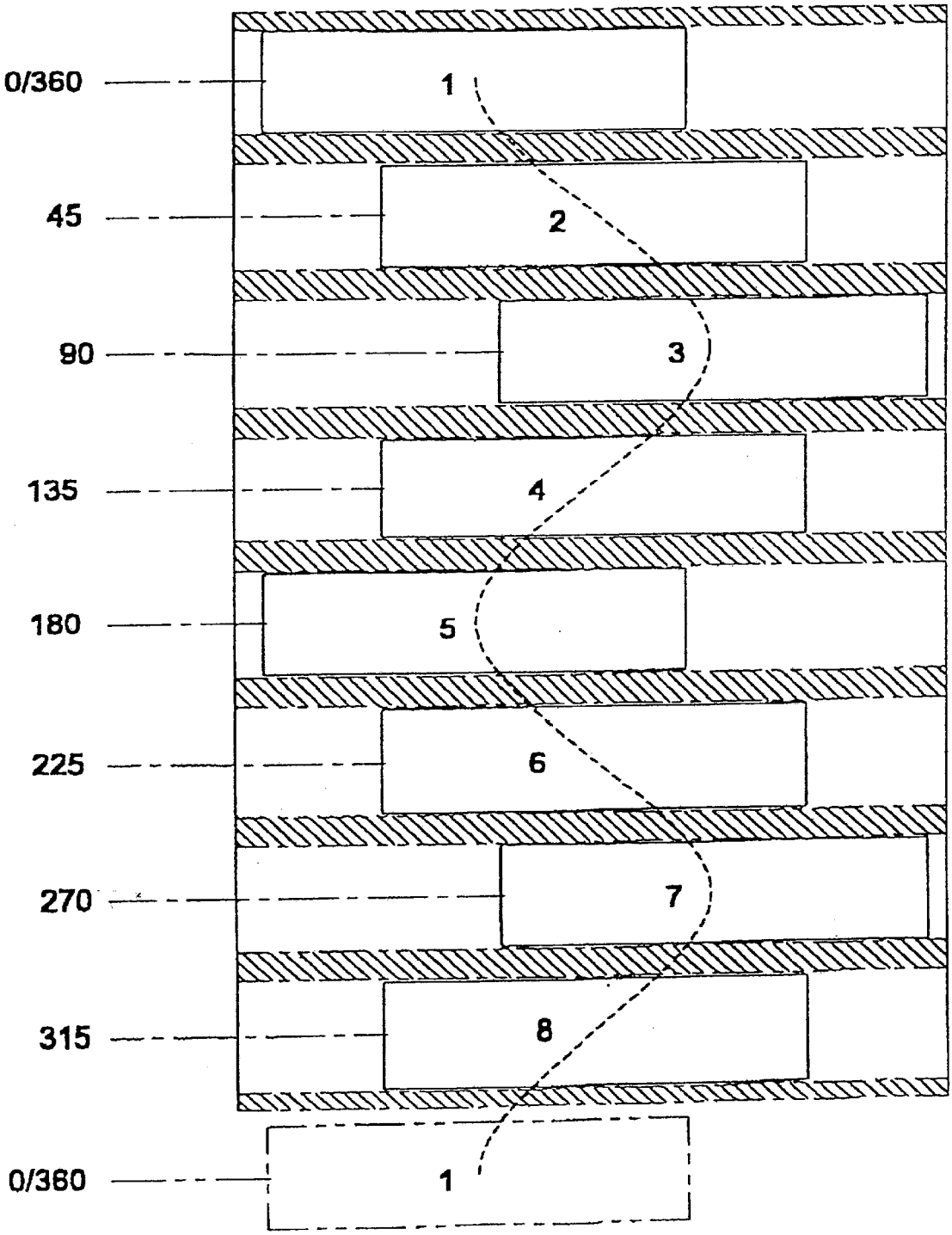
FIG. 3 is graphical view of the positions of a piston as the sinusoidal cam rotates through one revolution.

FIG. 3 shows the positions of the pistons in the eight cylinders if they were aligned next to each other. The dotted sinusoidal line indicates the contour of the sinusoidal surfaces as it interfaces the different pistons.

This figure illustrates the relation of the sinusoidal surface to the position of the different pistons and illustrates that in order to have multiple cylinders firing at the same time, the surface must have the rises and the reverse rises always aligned with a cylinder. Without this relationship, the cylinders would not fire in a substantially simultaneous manner.

Figure 5:
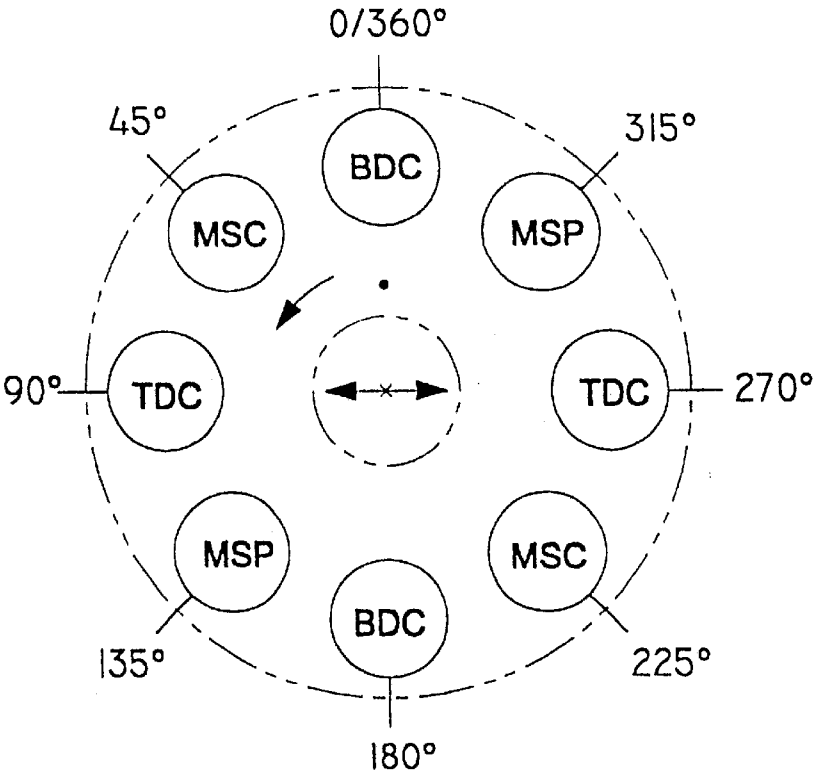
FIG. 5 is an illustrative view of the structure of the second end of the embodiment of FIG. 4 having 8 cylinders on each end and illustrating the different positions of the reverse rises of the cam surface with the arrow indicating the two reverse rises.
Figure 4:
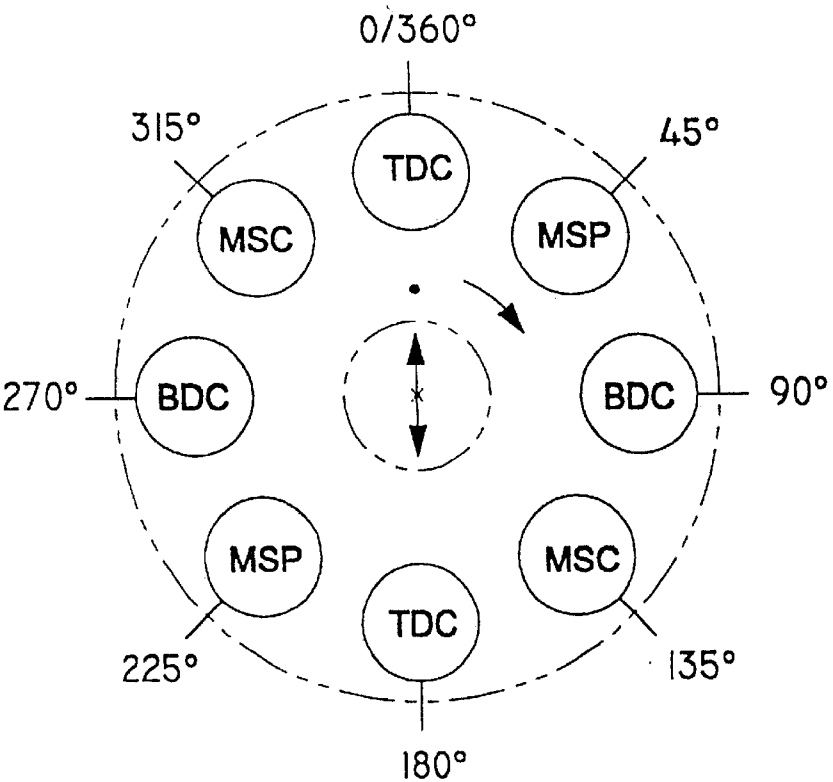
FIG. 4 is an illustrative view of the structure of the first end of an embodiment having 8 cylinders on each end and a sinusoidal surface having two rises and two reverse rises and illustrating the different positions of the rises of the cam surface with the arrow indicating the two rises.
Figure 7:
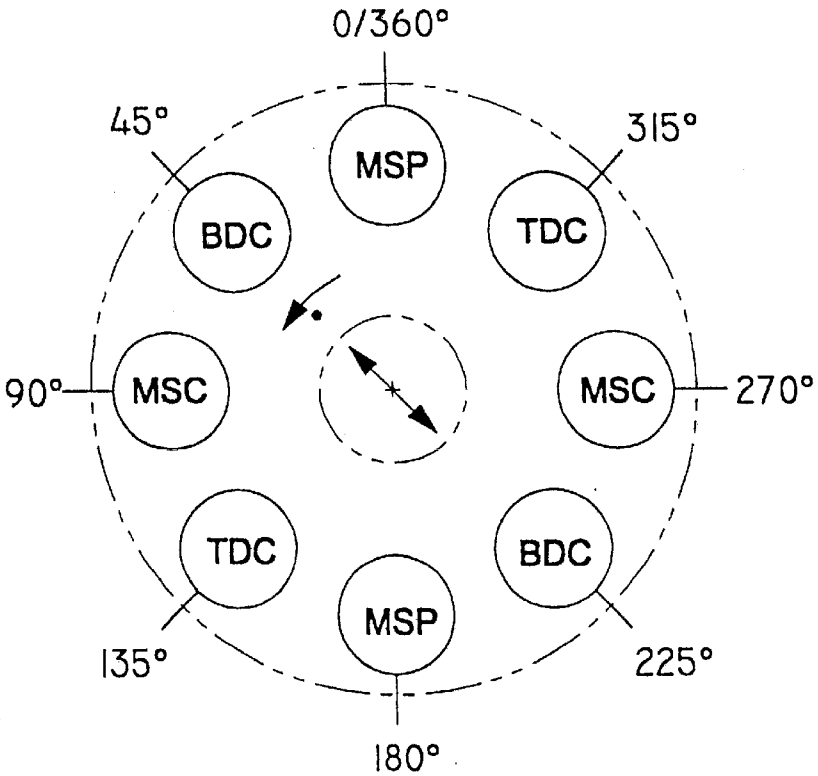
FIG. 7 is the view of FIG. 4 wherein the shaft and cam have advanced 90 degrees.
Figure 6:
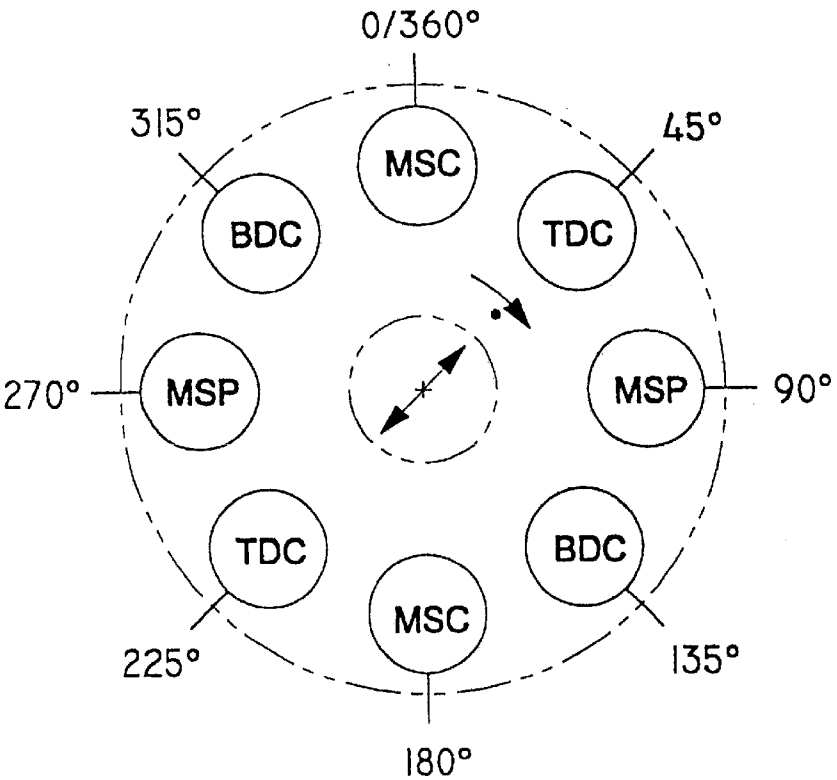
FIG. 6 is the view of FIG. 4 wherein the shaft and cam have advanced 45 degrees.
Figure 9:
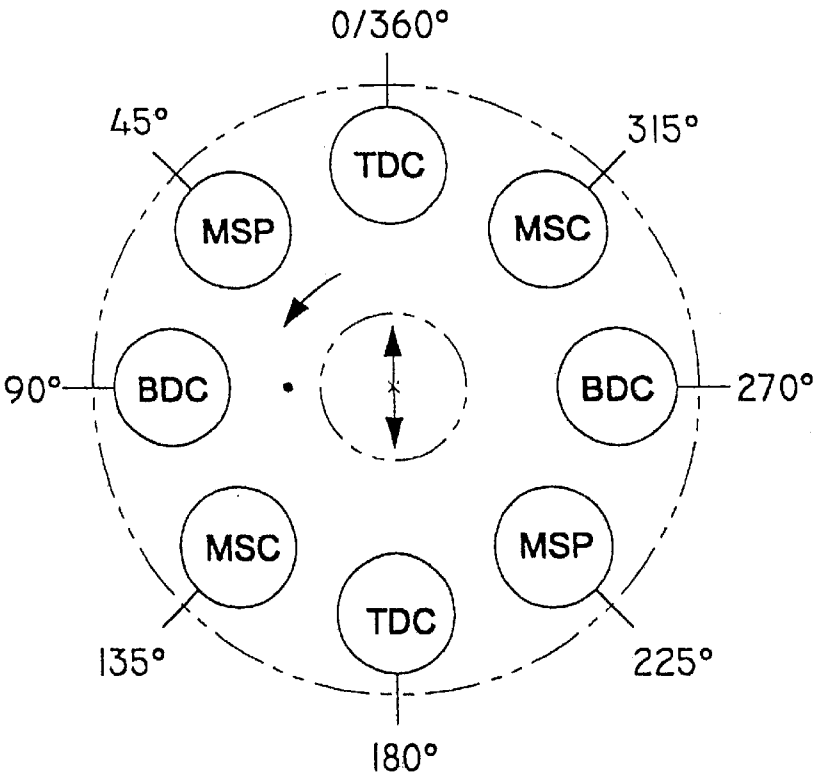
FIG. 9 is the view of FIG. 4 wherein the shaft and cam have advanced 180 degrees.
Figure 8:
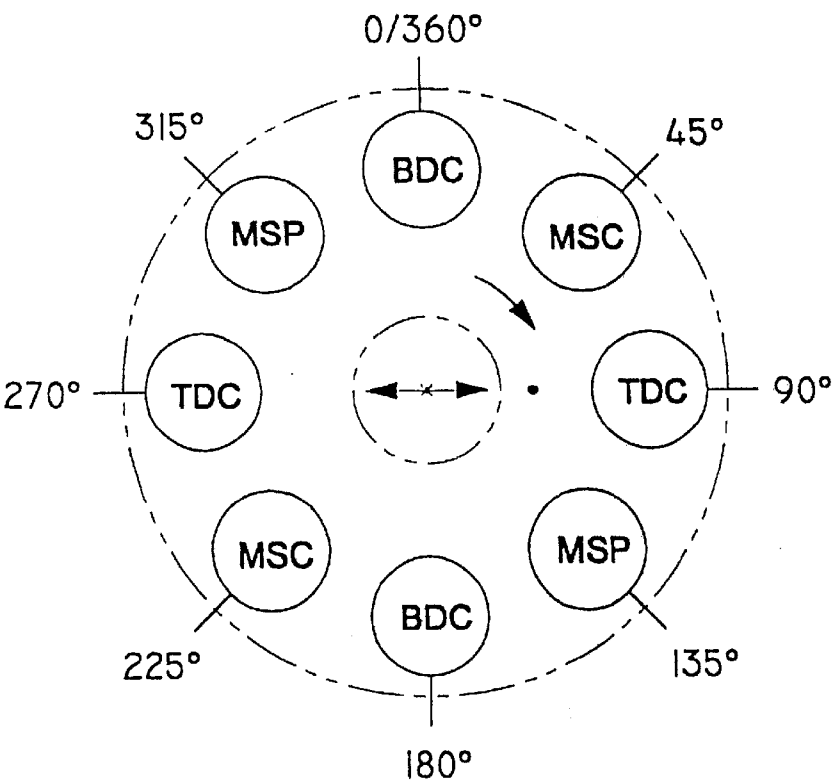
FIG 8 is the view of FIG. 4 wherein the shaft and cam have advanced 135 degrees.
Figure 11:
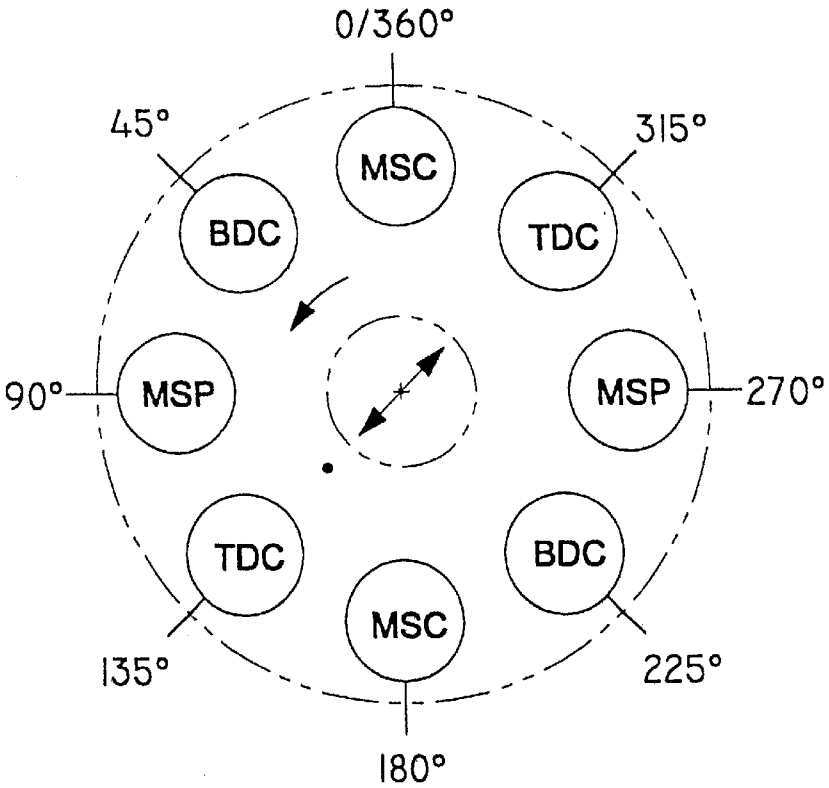
FIG. 11 is the view of FIG. 4 wherein the shaft and cam have advanced 270 degrees.
Figure 10:
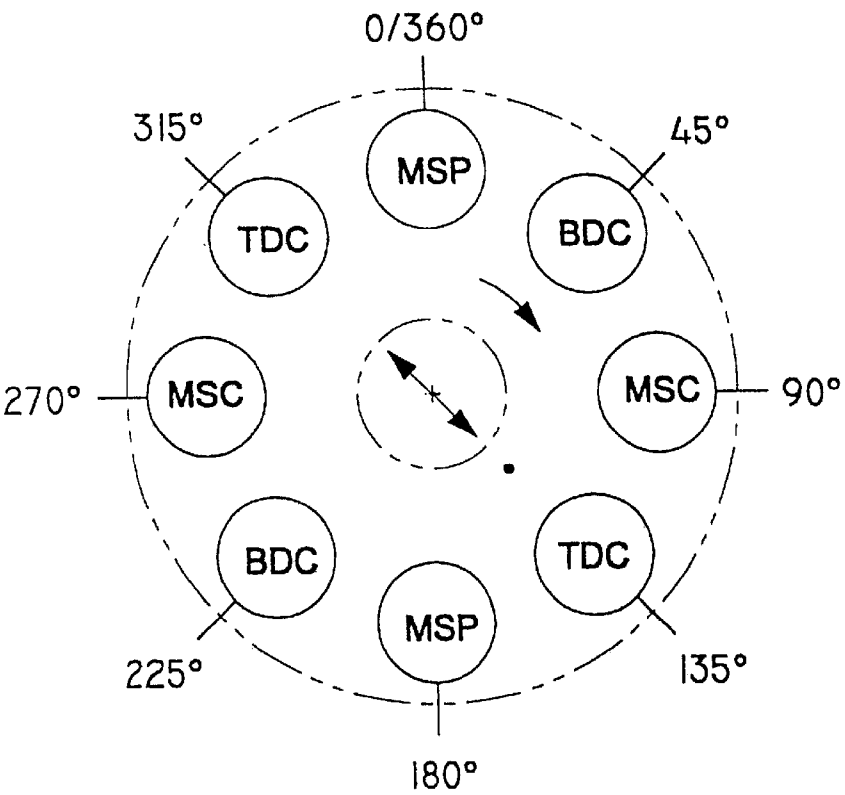
FIG. 10 is the view of FIG. 4 wherein the shaft and cam have advanced 225 degrees.
Figure 13:
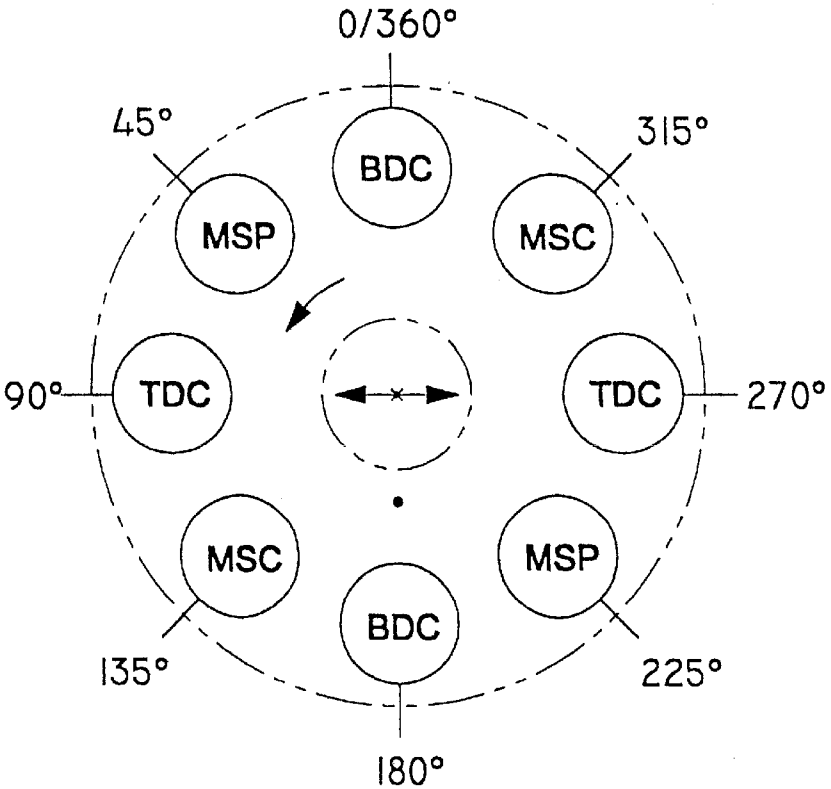
FIG. 13 is the view of FIG. 4 wherein the output shaft has returned to the 0/360 degree position.
Figure 12:
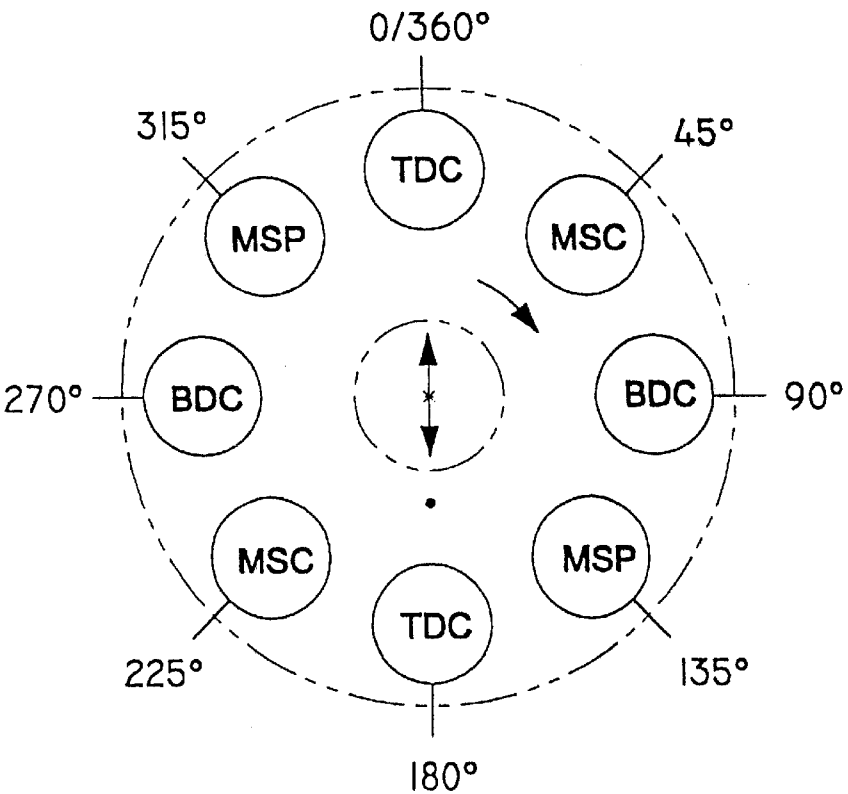
FIG. 12 is the view of FIG. 4 wherein the shaft and cam have advanced 315 degrees.

FIGS. 4 and 5 show the arrangement of Top Dead Center and Bottom Dead Center with respect to the different cylinders in each set of cylinders in the engine at the same point in time. FIG. 4 illustrates the positioning of TDC and BDC in the cylinders of the first end of the engine, as viewed from the second end of the engine while FIG. 5 illustrates the positioning of TDC and BDC in the cylinders of the second end of the engine.

FIGS. 4 and 6–13 illustrate the firing order of the first end of the engine over one complete rotation of the output shaft. These figures illustrate the clockwise order of the firing of the cylinders. The second end operates in the same manner as the first end with the exception that the order of firing is in the counterclockwise direction as shown in FIG. 5.

In each of the following sets of FIGS. 1–13 the left figure represents the first end of the engine, while the right figure illustrates the second end of the engine. The arrows in each of the figures represent the position on the output shaft when the pistons are at TDC with respect to the first end of the engine. Therefore, the arrows also represent the location of the rises on the sinusoidal surface with respect to that side of the engine. Each of the TDC and BDC indications on the figures are determined with respect to their own set of cylinders.

For example, in the position 0/360 the piston is at the top of its swing toward the first end and therefore it is labeled TDC in FIG.4, this is also the point at which a rise toward that end of the engine is aligned with the cylinder; while in FIG. 5, 0/360 is labeled BDC because it is at its farthest point from the second end. Therefore, with respect to FIGS. 4–13, the cylinders at the top of their power stroke, and firing simultaneously, are those labeled TDC.

Figure 15:
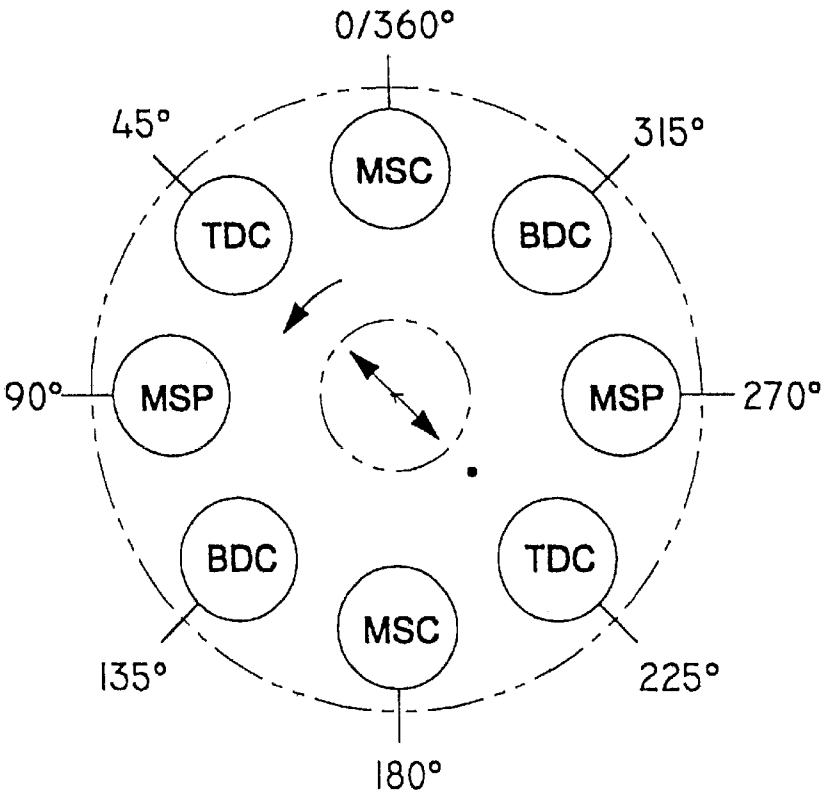
FIG. 15 is an illustrative view of the structure of the a second end of the embodiment of FIG. 14 having 12 cylinders on each end and illustrating the different positions of the rises of the cam surface with the arrow indicating one of the three reverse rises.
Figure 14:
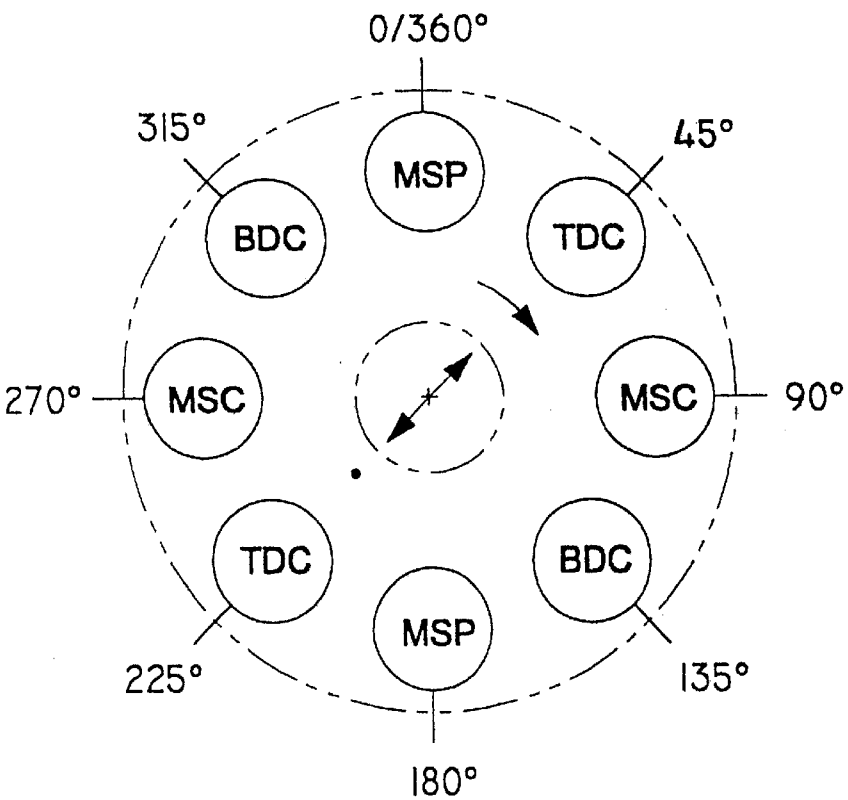
FIG. 14 is an illustrative view of the structure of the first end of an embodiment having 12 cylinders on each end and a sinusoidal surface having three rises illustrating the different positions of the rises of the cam surface with the arrow indicating one of the three rises.

Another embodiment of the invention, is shown in FIGS. 14 and 15. This embodiment is configured to provide three power strokes at one end of the engine that are in cylinders 120 degrees from each other (N=3, so according to the formula 360/3=120) and three power strokes in cylinders 120 degrees from each other (360/3) on the other end of the engine with an offset of 60 degrees (360/6) between the sets of power stroke cylinders on each of the two ends.

The configuration of the cylinders and the shape of the sinusoidal surfaces of the cam allows the six power strokes to take place substantially simultaneously on each power stroke of the engine. One arrangement of the cylinders of this configuration provides twelve common cylinder chambers with double headed pistons defining twelve cylinders (the number of cylinders is divisible by $N_r+N_{rr}$ which is 6) on each end of the engine. As can be seen by these examples, the formula can have many permutations and, therefore, the numbers of rises, reverse rises, and cylinders can also have many permutations.

Figure 16:
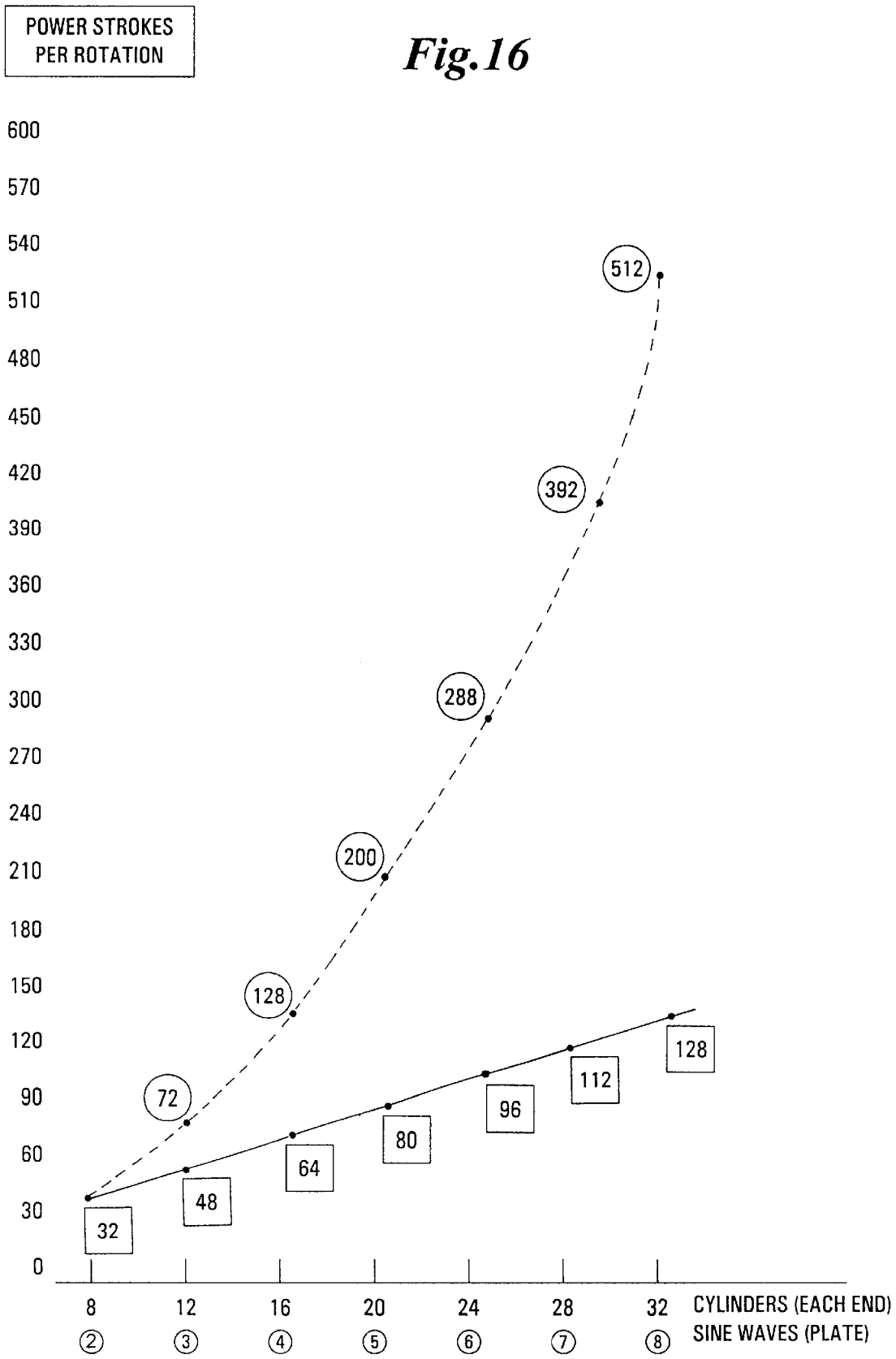
FIG. 16 is a graph illustrating the differences in simply identifying engine configurations by adding cylinders or sine waves and identifying axially and radially balanced engines by changing both the number of sine waves and the number of cylinders to specific quantities.

The graph in FIG. 16 shows the difficulty in identifying engines with radially and axially balanced firing engines. The solid line shown in the graph, indicates the common thinking in the prior art is to either increase the number of cylinders while using the same number of sine waves on the cam (such as two waves and 1, 2, 4, or more cylinders, for example) or to increase the number of sine waves and fix the number of cylinders (such as 4 cylinders and 2, 4, or 10 sine waves).

However, the graph also shows by a dashed line, that by utilizing the formula provided herein, engines having radial and axial balance can be easily identified. Not only do these engines offer drastically greater power than their prior art counterparts described on the linear line of the graph, but engines along this line are also radially and axially balance. This graph also shows that to find these balanced engines is not merely a linear relationship as it would be with the adjustment of either the number of cylinders or sine waves would be, but rather, is a complex function.

Since many possible embodiments may be made of the present invention without departing from the scope thereof, it is to be understood that all matter herein set forth or shown in the accompanying drawings is to be interpreted in the illustrative and not limiting sense.

What is claimed is:

1. A barrel-type internal combustion engine having at least twelve cylinders, each having a piston therein, arranged surrounding a central shaft having a cam with two opposing sinusoidal surfaces extending outward and around said shaft for positioning said pistons in said cylinders, said sinusoidal surfaces are each formed by a plurality of alternating, spaced rises and reverse rises, said number of cylinderw being greater than said number of spaced rises, and said engine is constructed and arranged to substantially simultaneously align each rise and reverse rise with a cylinder such that said engine can produce a power stroke substantially simultaneously in every cylinder aligned with a rise and reverse rise to provide both radial and axially balanced torque.

2. The engine according to claim 1, wherein the number of rises equals $N_r$ and the number of reverse rises equals $N_{rr}$ and wherein the number of cylinders is equal to any number divisible by $N_r+N_{rr}$.

3. The engine according to claim 1, wherein the number of rises is three and wherein the number of reverse rises is three and wherein the number of cylinders is equal to any number divisible by 6.

4. The engine according to claim 1, wherein the number of rises is two and wherein the number of reverse rises is two and wherein the number of cylinders is equal to any number divisible by 4.

5. The engine according to claim 1, wherein the alternating, spaced rises and reverse rises are equidistantly spaced from each other around the sinusoidal surfaces.

6. The engine according to claim 1, wherein all of the rises and reverse rises are aligned with a cylinder substantially simultaneously.

7. The engine according to claim 1, wherein said rise and reverse rises are offset by $360/(N_r+N_{rr})$ degrees with respect to each other, thereby positioning the rises in one sinusoidal surface in their opposite relation to the reverse rises of the other sinusoidal surface.

8. A barrel-type internal combustion engine having at least twelve cylinders arranged in in-line pairs, each cylinder having a piston head of a double headed piston positioned therein, said in-line pairs surrounding a drive shaft having a cam with at least three opposing sinusoidal surfaces engaged with the double headed pistons to position them within the cylinders, comprising;

each sinusoidal surface having N number of alternating rises and reverse rises equally spaced at 360/N degrees from each other, and curved surfaces connecting said rises and reverse rises forming a sinusoidal surface, the rises in one sinusoidal surface being opposite the reverse rises of the other sinusoidal surface; and said engine having a number of cylinders being greater than said number of rises, and constructed and arranged to align every rise and reverse rise with a cylinder such that said engine can substantially simultaneously produce a power stroke in every cylinder aligned with a rise or reverse rise to provide both radial and axially balanced torque.

9. A barrel-type internal combustion engine having at least twelve cylinders having pistons therein, arranged surrounding a central shaft having a cam with at least three opposing sinusoidal surfaces extending outward from said shaft and around said shaft for positioning said pistons in said cylinders, each said sinusoidal surface has a number of rises equal to $N_r$ and equally spaced at $360/N_r$ degrees from each other and $N_{rr}$ number of reverse rises spaced at $360/N_{rr}$ degrees, said reverse rises positioned at $360/(N_r+N_{rr})$ degrees from said rises, and curved surfaces connecting said rises and reverse rises on the same sinusoidal surface, the rises in one sinusoidal surface being opposite the reverse rises of the other sinusoidal surface; said engine having a number of cylinders being greater than said number of rises, and being constructed and arranged to substantially simultaneously align every rise and reverse rise with a cylinder such that said engine can produce a power stroke substantially simultaneously in every cylinder aligned with a rise or reverse rise to provide both radial and axially balanced torque.

10. The engine according to claim 9, wherein the number of cylinders is equal to $2N_r$.

11. The engine according to claim 9, wherein the number of cylinders is equal to $2N_{rr}$.

* * * * *